US009474321B2

(12) United States Patent
Heller

(10) Patent No.: US 9,474,321 B2
(45) Date of Patent: Oct. 25, 2016

(54) SHOE COVER DEVICE

(71) Applicant: Protexer, Inc., Knoxville, TN (US)

(72) Inventor: Robert Heller, Knoxville, TN (US)

(73) Assignee: Protexer, Inc., Knoxville, TN (US)

( * ) Notice: Subject to any disclaimer, the term of this patent is extended or adjusted under 35 U.S.C. 154(b) by 364 days.

(21) Appl. No.: 14/224,629

(22) Filed: Mar. 25, 2014

(65) Prior Publication Data

US 2015/0272365 A1 Oct. 1, 2015

(51) Int. Cl.

| | |
|---|---|
| ***A43B 3/16*** | (2006.01) |
| ***A43D 999/00*** | (2006.01) |
| ***A43B 3/10*** | (2006.01) |
| ***A47G 25/80*** | (2006.01) |

(52) U.S. Cl.

CPC ..... *A43B 3/163* (2013.01); *A43B 3/106* (2013.01); *A43D 999/00* (2013.01); *A47G 25/80* (2013.01)

(58) Field of Classification Search

CPC ..... A43B 3/106; A43B 3/163; A47G 25/905
USPC ..... 223/111, 112
See application file for complete search history.

(56) References Cited

U.S. PATENT DOCUMENTS

| | | | | |
|---|---|---|---|---|
| 3,775,793 | A | 12/1973 | Casavant | |
| 4,284,216 | A * | 8/1981 | Leland | A47G 25/905 223/111 |
| 5,593,071 | A * | 1/1997 | Lusk | A47G 25/905 223/111 |
| 6,234,369 | B1 * | 5/2001 | Bort | A47G 25/905 223/111 |
| 6,532,686 | B2 * | 3/2003 | Gultekin | A43B 3/163 36/7.1 R |
| 6,543,075 | B2 | 4/2003 | Gultekin | |
| 7,775,396 | B2 | 8/2010 | Xu | |
| 8,490,842 | B2 | 7/2013 | Xu | |
| 9,193,519 | B2 * | 11/2015 | Xu | A43B 3/106 |
| 2004/0244337 | A1 | 12/2004 | Asici | |
| 2007/0163912 | A1 | 7/2007 | Chen | |
| 2009/0152312 | A1 * | 6/2009 | Li | A43B 3/16 223/113 |

FOREIGN PATENT DOCUMENTS

| | | |
|---|---|---|
| GB | 2446669 | 8/2008 |
| JP | 09117301 | 5/1997 |
| WO | WO9116829 | 11/1991 |

* cited by examiner

*Primary Examiner* — Timothy Waggoner
(74) *Attorney, Agent, or Firm* — Luedeka Neely Group, P.C.

(57) ABSTRACT

A bootie application device that provides booties that slide along a rail system on tabs that releasably connect the booties to the rail system. A tensioning apparatus connects the rail system to the bootie application device. When an increased tension is applied to the rail system, the tensioning apparatus permits the rail system to move away from the application device by the expansion of the tensioning apparatus. When the increased tension is removed from the rail system, the rail system is drawn back toward the application device by the contraction of the tensioning apparatus.

5 Claims, 1 Drawing Sheet

SHOE COVER DEVICE

FIELD

This invention relates to the field of shoe covers. More particularly, this invention relates to an apparatus for dispensing shoe covers over a shoe on a foot without the wearer handling the shoe cover.

Many industries require their workers to wear protective clothing, either for the benefit of the environment in which the workers operate, or for the benefit of the workers themselves. For example, maintaining the cleanliness of the environment is important in industries such as pharmaceuticals, microelectronics, and food processing. On the other hand, there are a number of industries that produce dust, mist, spray, debris, and other hazardous materials, in which protective clothing is used to keep the workers clean or safe.

One item of protective clothing that is often used is shoe covers—so-called booties—that fit over a worker's feet, and either reduce the impurities that a worker brings into the controlled environment on his feet, or alternately, protect the worker's feet from the working environment.

Unfortunately, it can be very time-consuming to put on a pair of booties. Traditionally the process has been for the worker to take a couple booties out of a bin of such, walk over to a bench to sit down, and then—using both hands—place one bootie over each shoe. Not only is this a time-consuming process, but it requires the installation of benches (at accompanying cost and space), and also requires the workers to put down anything that they might be carrying in their hands.

Because of the time involved to implement this procedure, some workers attempt to put their booties on without sitting down. Unfortunately, the required process of standing on one leg while putting a bootie on the other foot tends to make the worker unstable, resulting in accidents, damage to property, and injury to self and others.

Further, because of the inadequacies of both of the options described above, some workers will, at times, not put on the booties at all, which tends to degrade the environment, put the worker at enhanced risk, or both.

Semi-automated devices have been developed to assist workers in putting on booties, such as those devices described in U.S. Pat. Nos. 7,775,396 and 8,490,842, and published application 20130270288, the entire disclosures of which are incorporated herein by reference. However, these devices tend to introduce new issues of their own.

SUMMARY

The above and other needs are met by a bootie application device that provides booties that slide along a rail system on tabs that releasably connect the booties to the rail system. A tensioning apparatus connects the rail system to the bootie application device. When an increased tension is applied to the rail system, the tensioning apparatus permits the rail system to move away from the application device by the expansion of the tensioning apparatus. When the increased tension is removed from the rail system, the rail system is drawn back toward the application device by the contraction of the tensioning apparatus.

In various embodiments according to this aspect of the invention, the rail system is a dual rail system. In some embodiments the tensioning apparatus comprises at least one of leaf springs, coil springs, and thermoplastic members. In some embodiments the tensioning apparatus includes a manually-adjustable portion. In some embodiments the tensioning apparatus includes a support bar that is selectively connected to the application device at one end, and slideably connected by a screw and a spring to the rail system at another end.

According to another aspect of the invention there is described a bootie application device of the type that provides booties that slide along a rail system on tabs that releasable connect the booties to the rail system. A tensioning apparatus connects the rail system to the bootie application device. The tensioning apparatus permits the rail system to move toward the application device by the contraction of the tensioning apparatus when an increased pressure is applied to the rail system, and draws the rail system back from the application device by the expansion of the tensioning apparatus when the increased pressure is removed from the rail system.

DRAWINGS

Further advantages of the invention are apparent by reference to the detailed description when considered in conjunction with the figures, which are not to scale so as to more clearly show the details, wherein like reference numbers indicate like elements throughout the several views, and wherein.

DESCRIPTION

Figure 1:
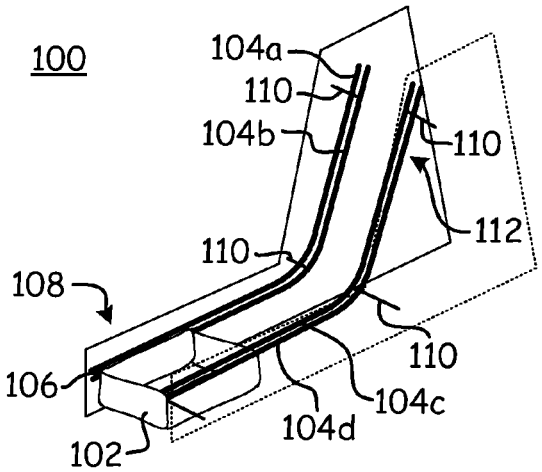
FIG. 1 depicts a perspective view of a bootie delivery system according to an embodiment of the present invention.

With reference now to the figures, there is depicted a shoe cover device 100, for both providing a store of booties 102, and facilitating the application of booties 102 to shoes, without the wearer having to handle the booties 102, or sit down. Thus, the shoe cover device 100 facilitates a faster, less invasive application of booties 102, and reduces the amount of space required in an ante room where booties 102 are to be applied.

In some embodiments the device 100 provides a store of booties 102 on an upper portion 112 of a rail system 104. The rail system 104 also delivers, opens, and stages the booties 102 for application at a lower portion 108 of the rail system 104. The booties 102 are releasable attached to the rail system 104.

In one embodiment, the rail system 104 includes a set of two rails 104*a* and 104*b* on one side of the device 100, and another set of two rails 104*c* and 104*d* on the other side of the device 100. Four tabs 106 are disposed around an elasticized opening of the bootie 102. Two of these four tabs 106 fit between the two rails 104*a* and 104*b* on one side of the device 100, and the other two of the four tabs 106 fit between the two rails 104*c* and 104*d* on the other side of the device 100.

In one embodiment, the two rails 104 of a given pair a/b or c/d of rails 104 are spaced apart such that a relatively thinner part of the tab 106 can slide easily between the rail pair 104 a/b or c/d, but a fatter part of the tab 106, disposed at a distal end of the tab 106, cannot pass easily through the gap between the rail pair 104 a/b or c/d, and thus the bootie 102 is retained by each tab 106 to the rail pair 104 a/b or c/d.

In this manner, the spacing between the sets a/b or c/d of rails 104 on either side of the device 100 stretches the bootie 102 along its width.

As the bootie 102 slides down the rail system 104 to the lower portion 108 of the rail system 104, also referred to as the application zone 108, the two tabs 106 on a given side of the device 100 are spread apart, thus stretching the bootie 102 along its length. Thus, in the application zone 108, the bootie 102 is opened up and configured to receive the shoe of the wearer.

The wearer places his shoe inside of the stretched-open bootie 102, and slides his foot backward out of the device 100. This motion either breaks the tabs 106 free from the rail system 104 in some manner, or slides the tabs 106 off of the end of the rail system 104, either of which action results in the bootie 102 being released by the device 100, and closing upon the shoe of the wearer. In some embodiments, this action also stretches the next bootie 102 open along its length, and pulls it into place in the application zone 108.

It is appreciated that the above describes just one embodiment of a rail system 104, and that other rails system 104 and tab 106 arrangements are also contemplated herein, such as single-rail rail system 104, with tabs 106 that releasably snap onto and off of the rail system 104.

Regardless of the specific configuration of the rail system 104 and the tabs 106, the rail system 104 is held in place on the device 100 by supports 110. The supports 110 hold the rail 104 pairs at an appropriate distance, one from another, so that the booties 102 are stretched at their width to an appropriate degree.

In some embodiments, the spacing between the rail sets 104 on either side of the device 100 is fairly critical, and thus, some way of adjusting the spacing is desirable. For example, if the spacing between the rails 104 in the upper portion 112 of the rail system 104 is not correct, then it can be very difficult to load the booties 102 into the device 100, or the booties 102 can be damaged by tearing the tabs 106 prematurely.

In some embodiments, this spacing is adjusted by swapping in supports 110 of different lengths. In other embodiments, this spacing is adjusted by making the supports 110 adjustable in length, such as by adjusting the length of the support 110, and then tightening it in place, such as with a wing nut. In this manner, the distance between the rail pairs 104 on either side of the device 100 can be adjusted. In yet another embodiment, the support 110 is somewhat self-adjusting, by connecting it at one end (either to the rail pair 104 or to the casing) by a tensioned fitting.

Figure 2:
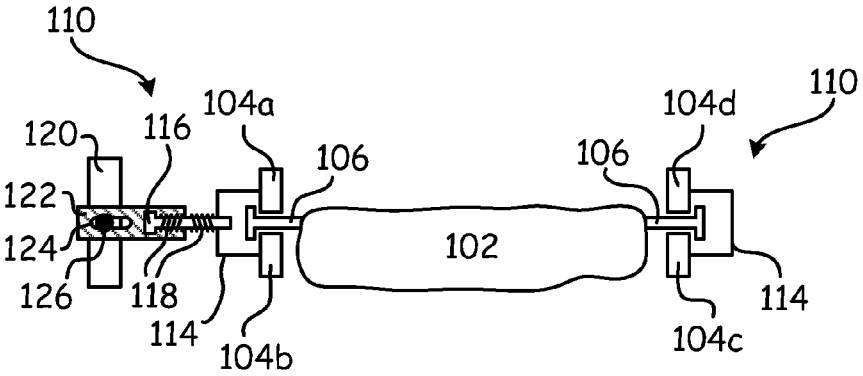
FIG. 2 depicts a first view of a track system for a bootie delivery system according to an embodiment of the present invention.
Figure 3:
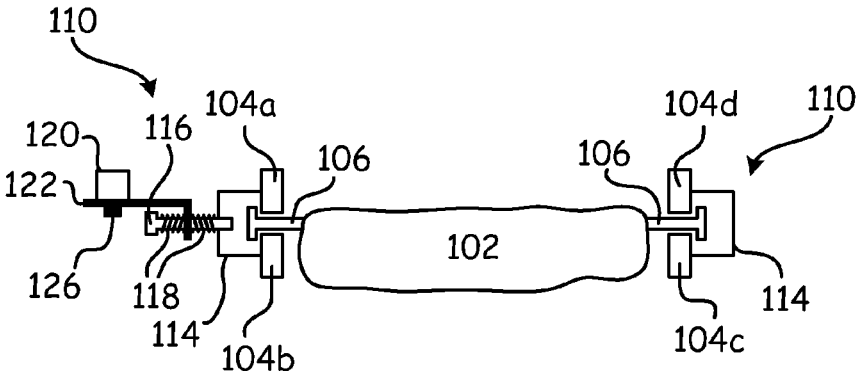
FIG. 3 depicts a second view of a track system for a bootie delivery system according to an embodiment of the present invention.

For example, and with particular reference to FIGS. 2 and 3, the support 110 can be a system of elements that cooperate one with another to provide both a manual and a self-adjusting tension and distance between the rail 104 sets a/b on one side of the device 100 and the rail 104 sets e/d on the other side of the device 100. It is appreciated that the support system 110 depicted on the left-hand side of FIGS. 2 and 3 could also be present on the right-hand side of these figures, or that a different support system 110 could be employed on either side of the device 100.

According to one embodiment, the support system 110 is connected on one end to a structural support 120, such as a frame member of the device 100. A support bar 122 is connected to the structural support 120, such as by a wing-nut or wing-bolt 126 that is fitted through a slot 124 in the support bar 122. Thus, by loosening the wing-bolt 126 and sliding the support bar 122 back and forth along the slot 124, and then tightening the wing-bolt 126, a manual method of adjusting the distance between the rails 104 a/b and rails 104 c/d is provided, which also manually adjusts the tension on the tabs 106 of the bootie 102.

In one embodiment, the support bar 122 is connected to a spacer member 114, which in turn is connected to one set of rails 104, either a/b or c/d, as depicted. The spacer member 114 holds the rails 104 a/b (for example) at the proper distance one from another, so that the tab 106 is retained between the rails 104 a/c without undue binding, but also so that the tab 106 does not come free from the rail system 104 until forceably removed by the wearer as described above.

The support bar 122 in one embodiment is connected to the spacer member 114 by a system that is both manually and automatically adjustable as to the tension on the bootie 102 and the distance between rail 104 sets a/b and c/d. For example, in one embodiment a threaded screw 116 fits loosely but retainably through a retaining hole in the support bar 122, and threads into the spacer member 114. Thus, a manual adjustment is provided by how far the threaded screw 116 is screwed into the spacer member 114. A lock nut or other means of retaining the threaded screw 116 at the desired position relative to the spacer member 114 is contemplated, but not depicted, so as to not unnecessarily encumber the drawings with elements that are relatively easily understood.

In some embodiments, one or more tensioning members 118 are provided between the support bar 122 and the spacer member 114. In the embodiment as depicted, the tensioning members 118 are coil springs 118, which are disposed around the threaded screw 116, and which tend to hold the rails 104 and spacer member 114 at a given distance from the support bar 122, but when a greater amount of tension is applied to the rails 104, will allow the rails 104 to pull further away from the support bar 122 and the frame 120 of the device 100, thus allowing easier movement of the bootie 102 without damaging the frangible tabs 106.

In other embodiments the function of the tensioning members 118 is provided by a leaf spring, an elastic member, or some other apparatus for allowing a tensioned separation between the spacer member 114 and one or both of the support bar 122 and the frame 120.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A bootie application device comprising:

a rail system including a first set of rails disposed adjacent a first side of the bootie application device and a second set of rails disposed adjacent a second side of the bootie application device opposite the first side of the bootie application device, the first set of rails operable to receive one or more tabs disposed on one end of a bootie and the second set of rails operable to receive one or more tabs disposed on a second end of the bootie such that the bootie is operable to slide from an upper portion of the rail system to a lower portion of the rail system and spacing between the first and second set of rails stretches the bootie along its width for assisting application of the bootie to a foot of a user adjacent the lower portion of the rail system; and a tensioning apparatus connected to at least one of the first and second set of rails, the tensioning apparatus operable to adjust the spacing between the first and second set of rails based on the width of the bootie being received by the rail system and applied to the foot of the user.

2. The bootie application device of claim 1, wherein the tensioning apparatus comprises at least one of leaf springs, coil springs, and thermoplastic members operable to expand the spacing between the first and second set of rails when an increased tension is applied to the rail system and operable to contract the spacing between the first and second set of rails when the increased tension is removed from the rail system.

3. The bootie application device of claim 1, wherein the tensioning apparatus comprises a manually-adjustable portion operable to contract the spacing between the first and second set of rails when an increased tension is applied to the rail system and operable to expand the spacing between the first and second set of rails when the increased tension is removed from the rail system.

4. A bootie application device comprising:

a rail system including a first set of rails disposed adjacent a first side of the bootie application device and a second set of rails disposed adjacent a second side of the bootie application device opposite the first side of the bootie application device, the first set of rails operable to receive one or more tabs disposed on one end of a bootie and the second set of rails operable to receive one or more tabs disposed on a second end of the bootie such that the bootie is operable to slide from an upper portion of the rail system to a lower portion of the rail system and spacing between the first and second set of rails stretches the bootie along its width for assisting application of the bootie to a foot of a user adjacent the lower portion of the rail system; and a tensioning apparatus connected to at least one of the first and second set of rails operable to adjust the spacing between the first and second set of rails based on the width of the bootie being received by the rail system and applied to the foot of the user, the tensioning apparatus comprising:

a manually adjustable tensioning member operable to contract the spacing between the first and second set of rails when an increased tension is applied to the rail system and operable to expand the spacing between the first and second set of rails when the increased tension is removed from the rail system, and an automatically adjustable tensioning member operable to expand the spacing between the first and second set of rails when an increased tension is applied to the rail system and operable to contract the spacing between the first and second set of rails when the increased tension is removed from the rail system.

5. The bootie application device of claim 4, wherein the automatically adjustable tensioning member comprises at least one of leaf springs, coil springs, and thermoplastic members.

* * * * *